US007165597B2

(12) United States Patent
Yamada et al.

(10) Patent No.: US 7,165,597 B2
(45) Date of Patent: Jan. 23, 2007

(54) INSERT CORE AND METHOD FOR MANUFACTURING A CYLINDER FOR INTERNAL COMBUSTION ENGINE BY MAKING USE OF THE INSERT CORE

(75) Inventors: Daiju Yamada, Kanagawa (JP); Kazuo Sasaki, Kanagawa (JP); Fujihiro Matsuura, Kanagawa (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/858,931

(22) Filed: Jun. 2, 2004

(65) Prior Publication Data

US 2005/0133189 A1 Jun. 23, 2005

(30) Foreign Application Priority Data

Dec. 22, 2003 (JP) ..... 2003-425408

(51) Int. Cl.
*B22D 19/02* (2006.01)

(52) U.S. Cl. ..... 164/98; 164/346

(58) Field of Classification Search ..... 164/98, 164/113, 132, 346; 29/156.4, 33 C
See application file for complete search history.

(56) References Cited

U.S. PATENT DOCUMENTS 3,844,334 A * 10/1974 Frederickson ..... 164/132
4,473,039 A * 9/1984 Kania ..... 123/73 R
4,651,686 A * 3/1987 Kania ..... 123/65 P
4,700,444 A * 10/1987 Yamagata ..... 29/888.061
5,285,840 A * 2/1994 Hayashi et al. ..... 164/132
5,947,066 A * 9/1999 Ishikawa ..... 123/65 P
6,142,113 A * 11/2000 Mochizuka et al. ..... 123/65 P
6,345,439 B2 2/2002 Matuura et al. ..... 29/888.06
6,886,520 B2 * 5/2005 Nozaki et al. ..... 123/193.2
2004/0261971 A1 12/2004 Matsumoto et al.

FOREIGN PATENT DOCUMENTS

DE 3707256 C1 7/1988
DE 4410934 C2 10/1994

(Continued)

*Primary Examiner*—Len Tran
(74) *Attorney, Agent, or Firm*—Baker Botts L.L.P.

(57) ABSTRACT

There is provided a method of cast molding a cylinder for an internal combustion engine by making use of an insert core, which makes it possible to rationally form the chamfered portions at the rim portion, on the cylinder bore side, of the scavenging ports, the suction port and the exhaust port with high precision and high freedom in dimension and configuration without fluctuation in size and configuration of the chamfered portion. Herein, the insert core is formed of a cylindrical body having a slightly smaller outer diameter than the diameter of cylinder bore, a scavenging port-forming portion projecting radially outward from the cylindrical body and having almost the same configuration as that of the scavenging port, a suction port-forming portion projecting radially outward from the cylindrical body and having almost the same configuration as that of the cylinder bore-side end portion of suction port, and an exhaust port-forming portion projecting radially outward from the cylindrical body and having almost the same configuration as that of the cylinder bore-side end portion of exhaust port. The insert core further includes chamfered portion-forming portions for forming a chamfered portion at each of the rim portions on the cylinder bore side of the scavenging ports, the suction port, and the exhaust port.

14 Claims, 15 Drawing Sheets

FOREIGN PATENT DOCUMENTS

| | | |
|---|---|---|
| JP | 53-77918 | 7/1978 |
| JP | 58155114 | 9/1983 |
| JP | 60-065256 | 4/1985 |
| JP | 5086971 | 4/1993 |
| JP | 2000-312962 | 11/2000 |
| WO | WO 00/068559 A1 | 11/2000 |

* cited by examiner

INSERT CORE AND METHOD FOR MANUFACTURING A CYLINDER FOR INTERNAL COMBUSTION ENGINE BY MAKING USE OF THE INSERT CORE

FIELD OF THE INVENTION

The present invention relates to an insert core to be employed in a method for manufacturing a cylinder for an internal combustion engine such as a small air-cooled two-stroke gasoline engine which is suited for use, for example, in a portable power working machine, and to a manufacturing method of the cylinder by making use of the insert core. In particular, the present invention relates to a manufacturing method of the cylinder by making use of an insert core which enables an undercut portion of the cylinder such as a scavenging port to be rationally formed on the occasion of manufacturing the cylinder by a die casting method such as a high-pressure die casting method.

DESCRIPTION OF THE RELATED ART

The cylinder of a small air-cooled two-stroke gasoline engine to be used in a portable power working machine is, as seen for instance from JP Laid-open Patent Publication (Kokai) No. 58-155114 (1983), generally formed of an aluminum alloy and constituted by an integral body consisting of a main body having a cylinder bore formed therein for allowing a piston to be fitted therein, and a head portion having a squishy dome-shaped combustion chamber formed therein, and by a large number of cooling fins projecting from all over the outer wall of the integral body.

The cylinder bore is provided with a suction port and also with an exhaust port, both of which are designed to be closed or opened by the movement of the piston, these suction port and exhaust port being arranged so as to face each other in an off set manner so that they disagree in level from each other. A plurality of hollow scavenging ducts, each being displaced away from these suction port and exhaust port by an angle of 90 degrees and having an inner wall of predetermined thickness, are formed along with the cylinder bore. The downstream end portion (upper end portion) of each hollow scavenging duct is constituted by a scavenging port, thereby providing a pair of scavenging ports which are disposed opposite to each other and designed to be opened and closed by the piston, these scavenging ports being inclined somewhat upward and directed in the direction opposite to the exhaust port of the cylinder bore.

The cylinder disclosed in the aforementioned JP Laid-open Patent Publication (Kokai) No. 58-155114 (1983) is a so-called binary fluid scavenging type cylinder where a pair of scavenging ports are symmetrically formed with respect to the longitudinal section taken along the middle of the exhaust port.

Additionally, a so-called quaternary fluid scavenging type cylinder where a pair of scavenging ports are additionally provided therewith (two pairs of scavenging ports in total) is also known.

As for the type of the scavenging passageway, there are known a hollow scavenging duct provided with an inner wall as shown in the aforementioned JP Laid-open Patent Publication (Kokai) No. 58-155114, a scavenging duct having no inner wall (the side facing the cylinder bore is opened), and a scavenging duct provided with a half-wall having a prescribed thickness, which is featured in that it is provided at a lower portion thereof with an opening (scavenging inlet opening) extending in the longitudinal direction of the scavenging duct while leaving a half-wall having a predetermined thickness at an upper portion thereof so as to allow an air-fuel mixture introduced into the scavenging port from the crank chamber via the scavenging duct to be contacted with a skirt portion of the piston.

In the manufacture of a cylinder provided with an inner wall-attached (or a half-wall-attached) hollow scavenging duct, in particular among the aforementioned cylinders for a two-stroke internal combustion engine, by a die casting method such as a high-pressure die casting method which enables cast moldings of high dimensional accuracy at low cost, the scavenging port portion of the scavenging duct which constitutes an undercut portion has been generally created by the following procedures. Namely, since a collapsible core for forming the cylinder bore portion cannot be employed under a high pressure, a raw cylinder body is cast-molded at first in such a manner that the scavenging port portion (constituting an undercut portion) thereof is left closed, and thereafter, this closed scavenging port portion is cut out by mechanical means (see JP Laid-open Patent Publication (Kokai) No. 58-155114 (1983)).

There is a problem however in the aforementioned method to cut out a scavenging port by mechanical means after the casting of raw cylinder body. Namely, since the space for allowing a cutting tool to be inserted into a working portion is very narrow, it is very difficult to perform the mechanical working and to enhance the operating accuracy of the scavenging port.

In this case, since the performance of a two-stroke internal combustion engine is greatly influenced by the size and configuration of the scavenging port as well as by the operating accuracy thereof, the aforementioned problem accompanied with the aforementioned mechanical working is very important.

It may be conceivable to manufacture a cylinder provided with an inner wall-attached hollow scavenging duct by a die casting method employing an insert core to be inserted into the scavenging port portion. In this case however, since part of the insert core is left to remain in the cast product, the heat conductivity thereof is deteriorated and at the same time, various problems such as the deformation or peeling due to the remaining insert core may be caused to occur.

With a view to overcome the aforementioned problems, the present inventors have previously proposed a method for manufacturing a cylinder for an internal combustion engine, where an insert core is employed as described below. Namely, according to this method, first of all, there is prepared an insert core comprising a cylinder body having substantially the same as the diameter of bore of the cylinder to be obtained and provided with a scavenging port-forming portion having substantially the same size in cross-sectional configuration as the aforementioned scavenging port, with a suction port-forming portion having substantially the same size in cross-sectional configuration at least as an end portion of the suction port located on the cylinder bore side, and with an exhaust port-forming portion having substantially the same size in cross-sectional configuration at least as an end portion of the exhaust port located on the cylinder bore side, all of said scavenging port-forming portion, said suction port-forming portion and said exhaust port-forming portion projecting radially outward from the cylinder body. Then, the cast-molding of the cylinder is performed by setting the insert core in such a manner that the insert core is externally inserted over a bore-core die to obtain a raw cylinder body with the insert core being left remained therein.

Thereafter, the cylinder bore of the resultant raw cylinder body is subjected to boring to cut and remove the cylindrical portion of the insert core, and then, the scavenging port-forming portion, the suction port-forming portion and the exhaust port-forming portion of the insert core which are left remained in the raw cylinder body are removed by making use of a press, for example, or other suitable apparatus. (JP Laid-open Patent Publication (Kokai) No. 2000-145536 and JP Patent Application No. 2002-259132).

According to the aforementioned manufacturing method, since the aforementioned insert core is employed, it is possible to utilize a high-pressure die casting method which enables to obtain a cast article of high dimensional accuracy. Moreover, since the cylindrical portion of the insert core can be removed by way of a rough boring of the cylinder bore after the die casting, and since all of the scavenging port-forming portion, the suction port-forming portion and the exhaust port-forming portion of the insert core that could not have been removed by the rough boring can be removed by making use of a press after the die casting, it is possible to make the resultant cast article (cylinder) completely free from any residuals of the insert core.

As a result, a cylinder can be manufactured in higher accuracy and at low cost as compared with the conventional method of cutting out the scavenging port portion by mechanical means after die casting or with the conventional manufacturing method by die casting where an insert core to be inserted into the scavenging port portion is employed. At the same time, it is now possible to obviate the aforementioned problems of the deterioration of heat conductivity as well as troubles such as the deformation or peeling of the insert portions due to the remnant of the insert core in the cast article (cylinder).

However, even in the aforementioned manufacturing method, the following problems are raised. Namely, according to the aforementioned manufacturing method, the cylinder to be manufactured is accompanied with a sharp edge portion at the rim portion, located on the cylinder bore side, of each of the scavenging port, the suction port and the exhaust port. As a result, performing a chamfering treatment is required on this sharp edge portion after the manufacture of the cylinder (mainly for the purpose of protecting the piston).

As for the method of this chamfering, there are various methods such as manual working, mechanical machining, electrochemical machining, electric discharge machining, or other suitable method. However, all of these chamfering methods are not optimal in that the degree of machining freedom with respect to the size and configuration of the chamfered portion is limited, that the operating accuracy is not optimal, and that the cost for the chamfering is expensive.

Furthermore, the size and configuration of the chamfered portion are liable to fluctuate, and if so, it would be difficult to mass-produce the cylinder which is excellent in uniformity in size and configuration of the chamfered portion thereof.

Further, if the operating accuracy at the chamfered portion is poor, the relative miss-matching among the scavenging port, the suction port and the exhaust port (the location of openings of these ports) is liable to occur. As a result, the timing of opening and closing these ports by the piston may become inaccurate; and if so, it would be difficult to obtain the prescribed performance desired of the engine.

BRIEF SUMMARY OF THE INVENTION

The present invention has been made to overcome the aforementioned problems, and therefore an object of the present invention is to provide an insert core as well as a method for manufacturing a cylinder for an internal combustion engine by making use of the insert core, which not only makes it possible to manufacture the cylinder by a die casting method such as a high-pressure die casting method at low cost and in high precision without raising problems such as the deterioration of heat conductivity, and the deformation or peeling of the cylinder, but also makes it possible to rationally form the chamfered portion at the rim portion, on the cylinder bore side, of the scavenging port, the suction port and the exhaust port with high precision and high freedom in dimension and configuration, i.e. without any fluctuation in size and configuration of the chamfered portion.

Another object of the present invention is to provide a method for manufacturing a cylinder for an internal combustion engine, where the insert core mentioned above is employed.

With a view to realize the aforementioned object, the present invention provides an insert core which is designed to be used in the manufacture of a cylinder provided with an inner wall-attached hollow scavenging duct having a scavenging port to be opened and closed by the movement of a piston, the insert core being featured in that it comprises a cylindrical body having a slightly smaller outer diameter than the diameter of bore of the cylinder to be obtained, a scavenging port-forming portion projecting radially outward from the cylindrical body and having substantially the same cross-sectional configuration as that of the scavenging port, a suction port-forming portion projecting radially outward from the cylindrical body and having substantially the same cross-sectional configuration as that of at least the cylinder bore-side end portion of a suction port, and an exhaust port-forming portion projecting radially outward from the cylindrical body and having substantially the same cross-sectional configuration as that of at least the cylinder bore-side end portion of an exhaust port; and that it further comprises chamfered portion-forming portions for forming a chamfered portion at each of the rim portions, on the cylinder bore side, of said scavenging port, said suction port and said exhaust port.

Preferably, the insert core is formed as an integral body by a die casting method using an aluminum alloy as a raw material.

As for the material for the insert core, it is not limited to the aforementioned aluminum alloy, but any other iron family metals can be employed. If the same kind of aluminum alloy as that of the cylinder is employed as a material for the insert core, the content of an additive such as silicon in the insert core may be increased larger than that for forming the cylinder, thereby enhancing the melting point of the insert core than that of the cylinder to thereby prevent the generation of a fusion bonding between the insert core and the cylinder.

On the other hand, the method of manufacturing a cylinder for an internal combustion engine according to the present invention is featured in that the cylinder is manufactured by a die casting method wherein the insert core having the aforementioned features is employed.

According to a preferable embodiment, the cylinder is manufactured by a process wherein the insert core is externally attached to a bore-core die, the resultant casting die is then employed to cast-mold a raw cylinder body with the insert core being left remained therein. Thereafter, the resultant raw cylinder body is subjected to boring for forming a cylinder bore to remove a cylindrical portion of the insert core. The scavenging port-forming portion, suction port-forming portion, and exhaust port-forming portion of the insert core, which are left remained in the raw cylinder body, are then removed by being pushed radially inward by making use of a press, for example, or other suitable apparatus, thus obtaining a cylinder having a chamfered portion formed at each of the rim portions, on the cylinder bore side, of said scavenging port, said suction port, and said exhaust port.

It is preferable in this case to coat or plate a parting agent on the outer surface of at least the scavenging port-forming portion, suction port-forming portion and exhaust port-forming portion of the insert core, thereby forming a mold-releasing layer prior to the step of die casting.

As for the parting agent to be coated or plated on the outer surface of the insert core, chromium, nickel, carbon, or other suitable material can be employed. The coating or plating of these parting agents may be suitably performed using electrolytic plating or vapor deposition for instance, thus forming a mold-releasing layer.

According to the aforementioned preferable embodiments of the method of manufacturing a cylinder for an internal combustion engine by making use of the insert core which is constructed according to the present invention, it is possible, due to the employment of the insert core, to utilize a high-pressure die casting method which enables to obtain a cast article of high dimensional accuracy at low cost. Additionally, since the cylindrical portion of the insert core can be removed by way of a rough boring of the cylinder bore after the die casting, and since the residual portion of the insert core (i.e. the scavenging port-forming portion, suction port-forming portion and exhaust port-forming portion of the insert core) that cannot be removed by the rough boring can be easily and simply removed by making use of a press after the die casting, it is possible to make the resultant article completely free from any residuals of the insert core.

As a result, a cylinder can be manufactured in higher precision and at low cost as compared with the conventional method of cutting out the scavenging port portion by mechanical means after die casting or with the conventional manufacturing method by die casting where an insert core to be inserted into the scavenging port portion is employed. At the same time, it is now possible to obviate the aforementioned problems of the deterioration of heat conductivity as well as the deformation or peeling of these port portions due to the remnant of the insert core in the cast article (cylinder).

Furthermore, since all of these scavenging port-forming portion, suction port-forming portion and exhaust port-forming portion are formed integral with the insert core (the cylindrical portion thereof), it is possible to univocally determine the positions of the scavenging port, the suction port and the exhaust port, thereby preventing the generation of relative mismatching among the scavenging port, the suction port and the exhaust port that may be caused to occur in the conventional manufacturing method where these scavenging port-forming portion, suction port-forming portion, and exhaust port-forming portion are provided separate from the insert core. Therefore, it is now possible to obtain a cylinder which is excellent in dimensional accuracy.

Additionally, since the configurations of these scavenging port-forming portion, suction port-forming portion, and exhaust port-forming portion can be optionally selected as long as they can be physically detached or removed after the rough boring of the cylinder bore, the configuration, contraction ratio, and inclination angle of these scavenging port, suction port, and exhaust port can be optionally selected, thereby making it possible to increase the degree of freedom in designing these ports as compared with the case where these ports are formed by electric discharge machining and at the same time, it is possible to save the manufacturing cost of the cylinder.

According to the method of manufacturing a cylinder for an internal combustion engine as proposed by the present invention, since the scavenging port-forming portion, the suction port-forming portion, and the exhaust port-forming portion of the insert core are respectively provided with a chamfer-forming portion for forming a chamfered portion at the rim portion, on the cylinder bore side, of each of the scavenging port, the suction port, and the exhaust port, it is now possible to form a chamfered scavenging port, a chamfered suction port, and a chamfered exhaust port at the rim portion, on the cylinder bore side, of each of these ports by the procedures wherein after a cast-molded raw cylinder body having the insert core placed therein is obtained, the resultant raw cylinder body is subjected to boring to remove a cylindrical portion of the insert core, and the scavenging port-forming portion, suction port-forming portion, and exhaust port-forming portion of the insert core, which are left remained in the raw cylinder body, are then removed by being pushed radially inward by making use of a press, or other suitable apparatus. Therefore, performing the chamfering working, on the cylinder bore side, of each of the scavenging port, the suction port and the exhaust port after the manufacture of the cylinder.

In this case, since it is possible, according to the manufacturing method of the present invention, to design the chamfered portion-forming portion in any optional configuration at each of the scavenging port-forming portion, suction port-forming portion, and exhaust port-forming portion of the insert core, the chamfered portion to be formed on the cylinder bore side of each of the scavenging port, the suction port, and the exhaust port can be freely varied in size and configuration along the entire circumference of the openings of these ports, thereby making it possible to greatly enhance the freedom in size and configuration of the chamfered portion.

Moreover, since the size and configuration of the chamfered portion-forming portions can be fixed in advance, it is now possible to form the chamfered portions with higher precision and with minimal irregularity in size and configuration of the chamfered portion as compared with the chamfered portions that can be formed in the conventional manner such as manual working, mechanical machining, electro-chemical machining, electric discharge machining, or other traditional methods.

Furthermore, it is also possible, according to the manufacturing method of the present invention, to reduce the cost for forming the chamfered portion and to obtain the cylinder which is excellent in uniformity on the occasion of mass-producing the cylinder. Additionally, a curved chamfered portion (radiused configuration and the like) that cannot be easily achieved by the conventional method such as manual working, mechanical machining, electro-chemical machining, electric discharge machining, or other suitable method can be easily obtained by the manufacturing method as proposed by the present invention.

Further, since it is possible to univocally determine the size and configuration of the chamfered portions, the generation of relative miss-matching among the scavenging port, the suction port, and the exhaust port (the location of openings of these ports) can be suppressed. As a result, it is now possible to properly maintain the timing of opening and closing these ports by the piston all the time, thereby making it possible to secure the prescribed performance desired of the engine.

DETAILED DESCRIPTION OF THE INVENTION

The present invention will be further explained with reference to one embodiment of the manufacturing method of a cylinder for an internal combustion engine where an insert core is employed according to the present invention.

Figure 13:
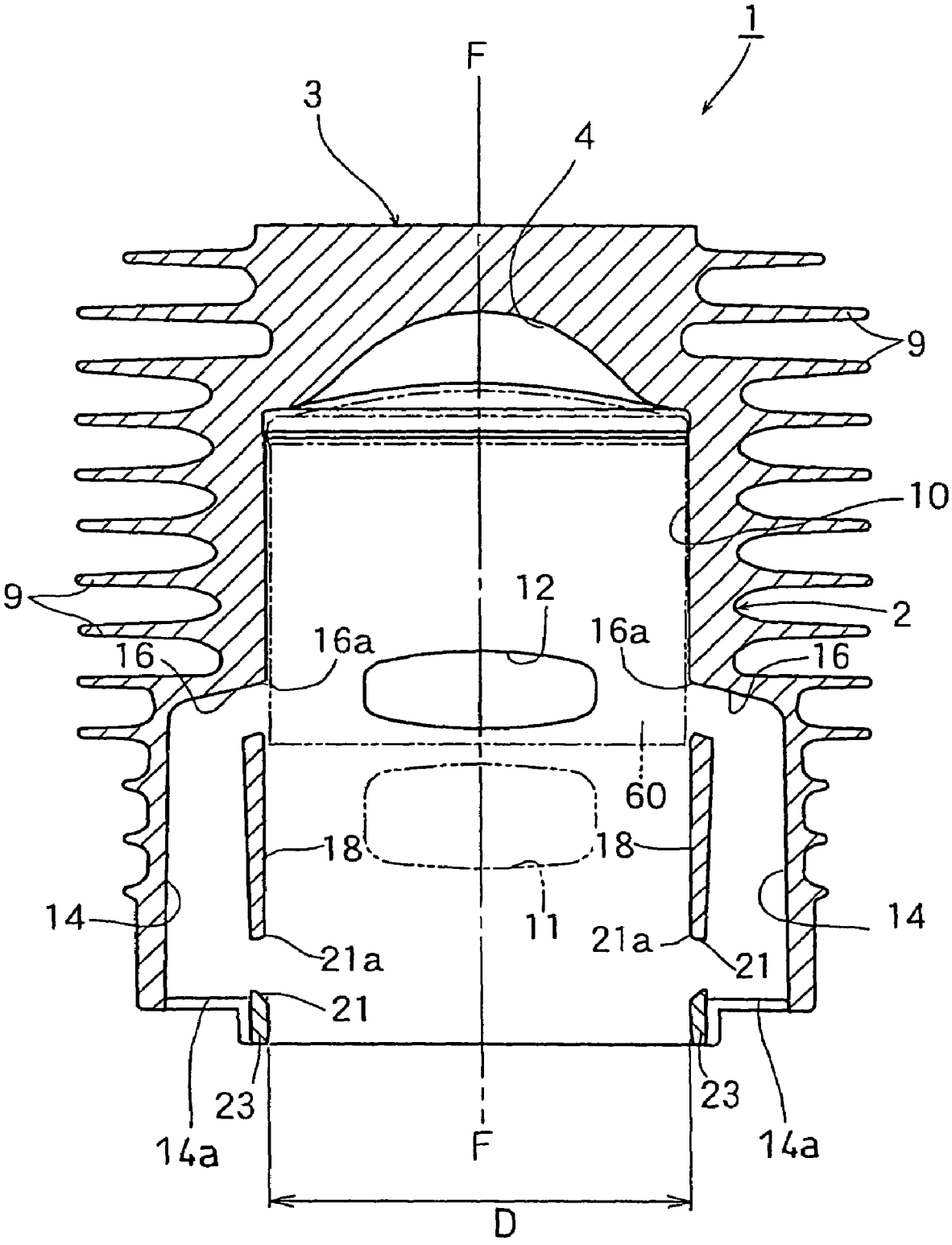
FIG. 13 is a longitudinal sectional view for illustrating a finished cylinder for a small air-cooled two-stroke internal combustion engine, which can be manufactured by the method of manufacturing a cylinder for an internal combustion engine using an insert core according to the present invention, wherein the scavenging duct is longitudinally sectioned.
Figure 14:
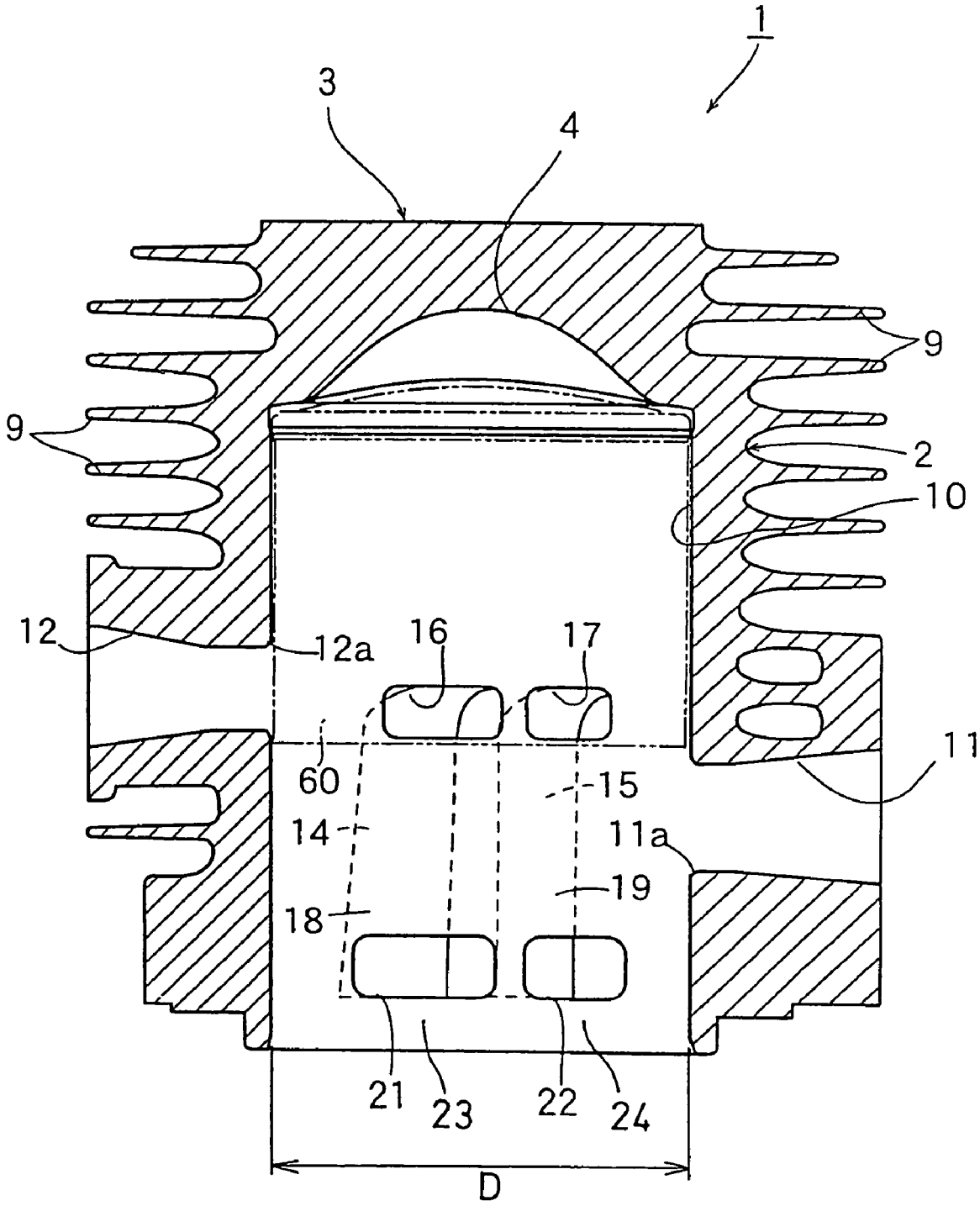
FIG. 14 is a longitudinal sectional view for illustrating a finished cylinder for a small air-cooled two-stroke internal combustion engine, which can be manufactured by the method of manufacturing a cylinder for an internal combustion engine using an insert core according to the present invention, wherein the suction port and the exhaust port are respectively longitudinally sectioned.

The cylinder for an internal combustion engine, which can be manufactured by the method according to this embodiment, is a cylinder 1 for a small air-cooled two-stroke gasoline engine as shown in FIG. 13 (a longitudinal sectional view wherein the scavenging duct thereof is longitudinally sectioned) and FIG. 14 (a longitudinal sectional view wherein the suction port and exhaust port thereof are longitudinally sectioned), which can be employed in a portable working machine. This cylinder 1 is formed of an aluminum alloy and comprises an integral body consisting of a main body 2 having a cylinder bore 10 for allowing a piston 60 to be fitted therein, a head portion 3 provided therein with a combustion chamber 4 having a semi-spherical configuration for instance, and a large number of cooling fins 9 which are formed all over the outer wall of the integral body. Further, the combustion chamber 4 is provided with an ignition plug-mounting hole (not shown) (in which an internal thread will be formed after cast molding).

The cylinder bore 10 is provided with a suction port 11 and with an exhaust port 12, which are to be closed and opened by the movement of the piston 60, these suction port 11 and exhaust port 12 being disposed to face each other and off-set level-wise from each other. Two pairs of hollow scavenging ducts 14 and 15, each pair being displaced away from these suction port 11 and exhaust port 12 by an angle of 90 degrees, are formed along with the cylinder bore 10. Namely, the cylinder 1 in this case is a so-called quaternary fluid scavenging type cylinder where two pairs of scavenging ports are symmetrically formed with respect to the longitudinal cross-section F taken along the middle of the exhaust port 12. The downstream end portion (upper end portion) of each hollow scavenging passageway 14 (or 15) is constituted by a scavenging port 16 (or 17), thereby providing two pairs of scavenging ports (scavenging outlet ports) 16 and 17 disposed opposite to each other, which are designed to be opened and closed by the movement of the piston 60 and are inclined somewhat upward in the direction opposite to that of the exhaust port 12 (i.e. directed toward the suction port 11) of the cylinder 10.

These paired scavenging ducts 14 and 15 are respectively provided with a half wall. Namely, these paired scavenging passageways 14 and 15 are provided at an upstream end portion (at a lower end portion) thereof with paired scavenging inlets 21 and 22, respectively. Between these paired scavenging inlet openings 21 and 22 and these paired scavenging outlet ports 16 and 17, there are disposed a pair of intermediate walls 18 forming the same diameter as that of the cylinder bore 10 and having a predetermined wall thickness. Further, on the lower side of these paired scavenging inlet openings 21 and 22, there are disposed paired lower end walls 23 and 24, respectively.

Figure 15:
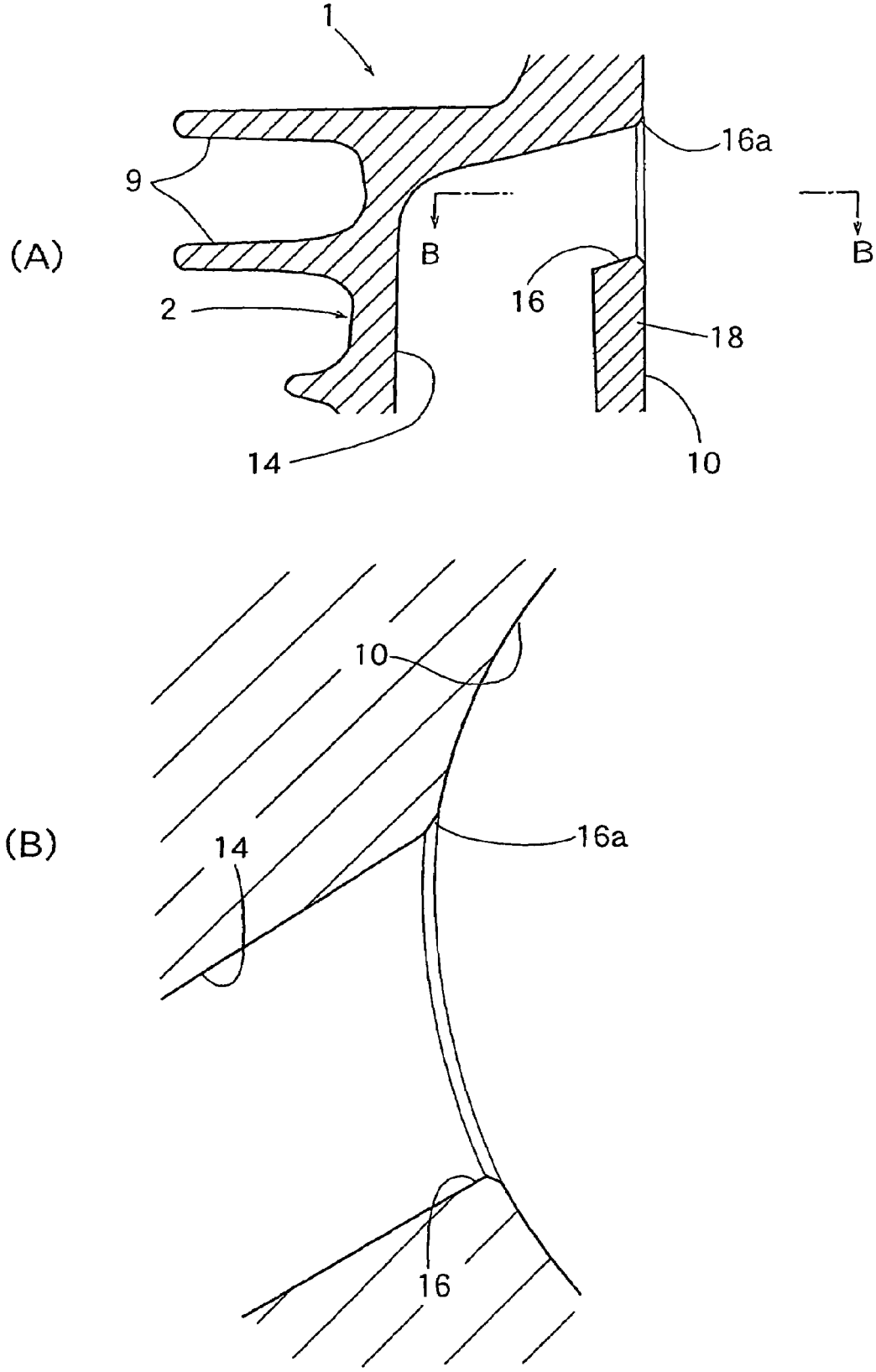
FIG. 15 shows the scavenging port portion shown in FIGS. 13 and 14, wherein (A) is an enlarged longitudinal sectional view of the main portion thereof, and (B) is an enlarged cross-sectional view taken along the line B—B of (A).

At each of the paired scavenging outlet ports 16 and 17, the paired scavenging inlet openings 21 and 22, the rim portion, on the cylinder bore side, of the suction port 11, and the rim portion, on the cylinder bore side, of the exhaust port 12, there are formed chamfered portions (chamfered along the entire circumference thereof) 16*a*, 17*a*, 21*a*, 22*a*, 11*a* and 12*a*, respectively. FIG. 15 illustrates an enlarged view of the chamfered portion 16*a* of the scavenging port 16, which is shown as a representative of other chamfered portions.

In the manufacturing method according to this embodiment for obtaining the cylinder 1 described above, an insert core 30 as shown in FIG. 1 is employed. Namely, this insert core 30 shown in this FIG. is formed of an integrally molded body that can be obtained by a die casting method and comprises: a cylindrical body 32 having an outer diameter Di slightly smaller (i.e. smaller at least by a thickness corresponding to a mold releasing layer 61) than the diameter D of the bore of the cylinder 1 desired to obtain; two pairs of scavenging port-forming portions 36 and 37, each pair being positioned opposite to each other, projecting radially outward from the cylindrical body 32 and having substantially the same cross-sectional configuration as that of the scavenging ports 16 and 17, respectively; two pairs of scavenging inlet opening-forming portions 38 and 39, each pair being positioned opposite to each other, projecting radially outward from the cylindrical body 32 and having substantially the same cross-sectional configuration as that of the scavenging inlet openings 21 and 22, respectively; a suction port-forming portion 41 projecting radially outward from the cylindrical body 32 and having substantially the same cross-sectional configuration as that of the cylinder bore-side end portion of a suction port 11; and an exhaust port-forming portion 42 projecting radially outward from the cylindrical body 32 and having substantially the same cross-sectional configuration as that of at least the cylinder bore-side end portion of an exhaust port 12. The insert core 30 is further provided, at a proximal end portion of each of the scavenging port-forming portions 36 and 37, of each of the scavenging inlet opening-forming portions 38 and 39, of the suction port-forming portion 41 and of the exhaust port-forming portion 42, with divergent chamfered portion-forming portions 36*a*, 37*a*, 38*a*, 39*a*, 41*a* and 42*a* for forming chamfered portions 16*a*, 17*a*, 21*a*, 22*a*, 11*a* and 12*a*, respectively, at each of the rim portions, on the cylinder bore side, of the scavenging ports 16 and 17, the scavenging inlet openings 21 and 22, the suction port 11 and the exhaust port 12.

In this case, in the same manner as the positional relationships of the suction port 11 and the exhaust port 12 with respect to each of the scavenging ports 16 and 17 of the cylinder 1, these suction port-forming portion 41 and exhaust port-forming portion 42 are disposed to face each other in an off-set manner so that they disagree in level from each other and displaced away from these scavenging ports 16 and 17 by an angle of about 90 degrees. FIG. 2 is a cross-sectional view of the insert core shown in FIG. 1, wherein the scavenging port-forming portions 36 and 37, suction port-forming portion 41 and exhaust port-forming portion 42 thereof are depicted assuming that they are arranged on the same plane.

Figure 4:
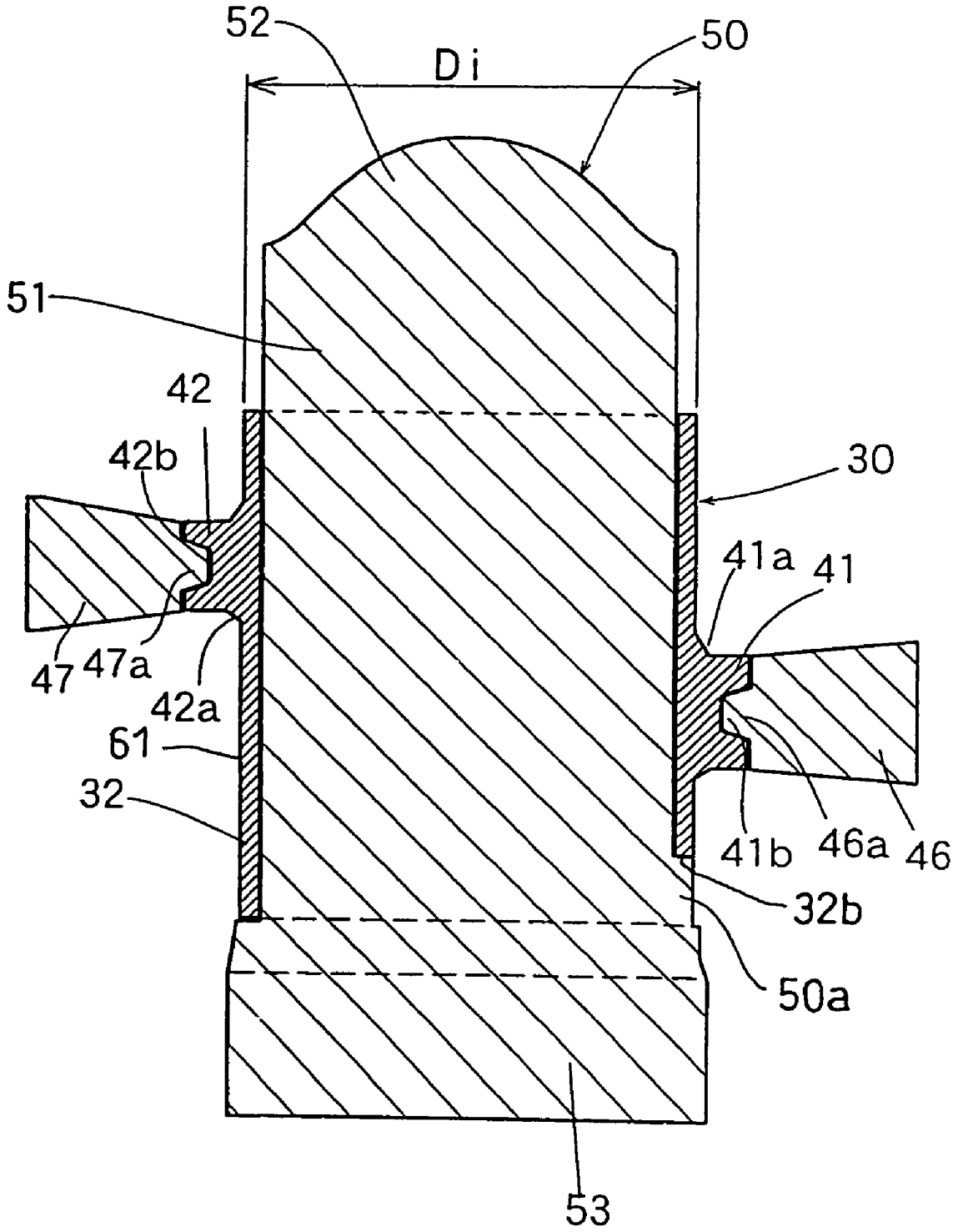
FIG. 4 is a longitudinal sectional view of the suction port-forming portion and the exhaust port-forming portion of the insert core of FIG. 1, as the insert core is set in position in a bore-core die.

As clearly seen from FIGS. 2 and 4, these suction port-forming portion 41 and exhaust port-forming portion 42 are provided respectively with fitting holes 41*b* and 42*b*, into which truncated cone-shaped bosses 46*a* and 47*a* formed respectively at the distal end portion of the core 46 for suction port and of the core 47 for exhaust port are designed to be fitted, respectively. In this case, each of these cores 46 and 47 has a cross-sectional configuration which is approximately the same cross-sectional configuration as that of each of the suction port 11 and the exhaust port 12 excluding the cylinder bore-side end portion thereof, these cores 46 and 47 being formed of steel or other suitable material, thereby enabling them to be repeatedly used. These fitting holes 41*a* and 42*a* are effective for the positioning the cores and for preventing the falling-off of the cores and also effective for reducing the quantity of the material to be employed for these cores.

Figure 1:
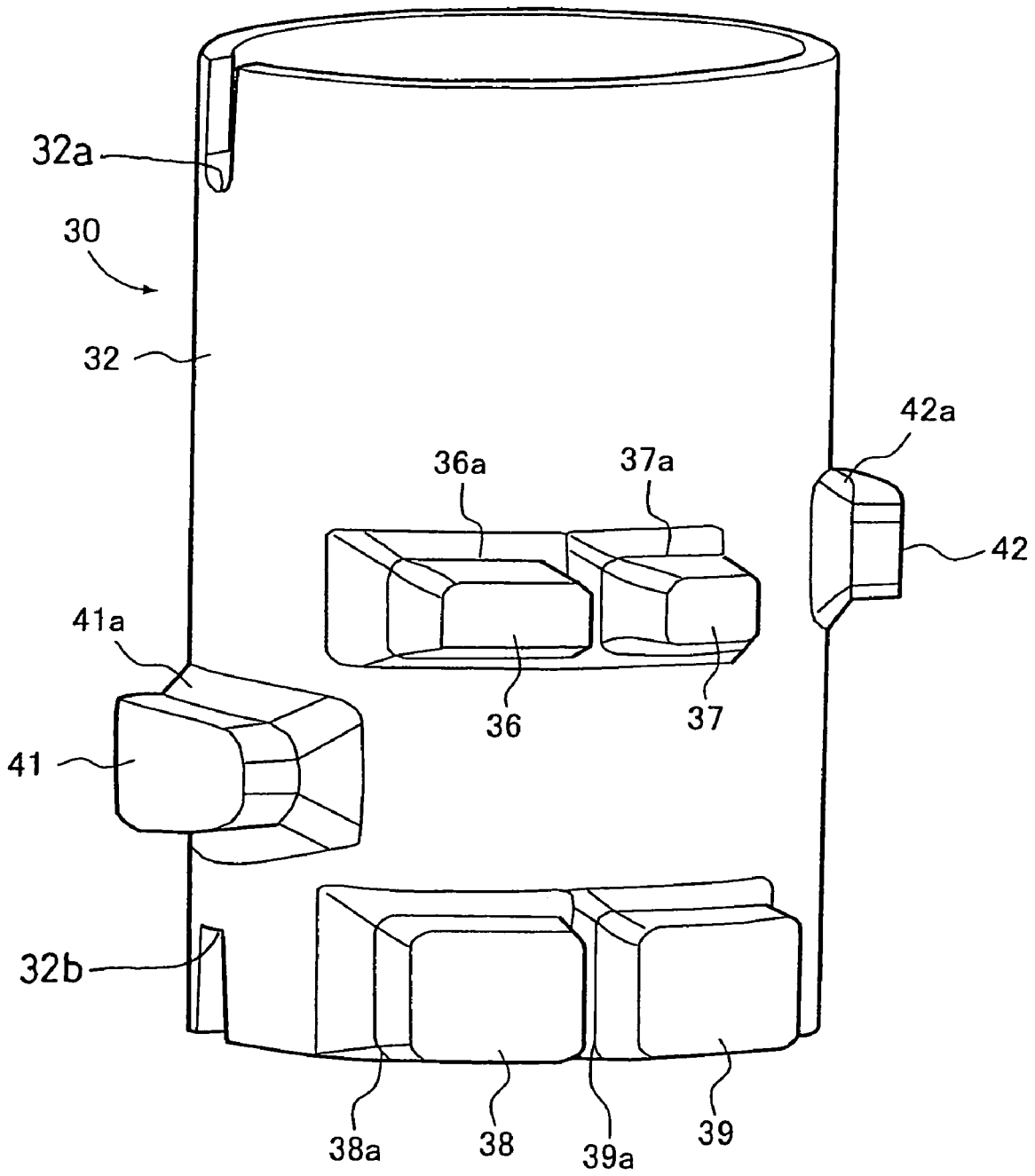
FIG. 1 is a perspective view illustrating one embodiment of the insert core according to the present invention.
Figure 2:
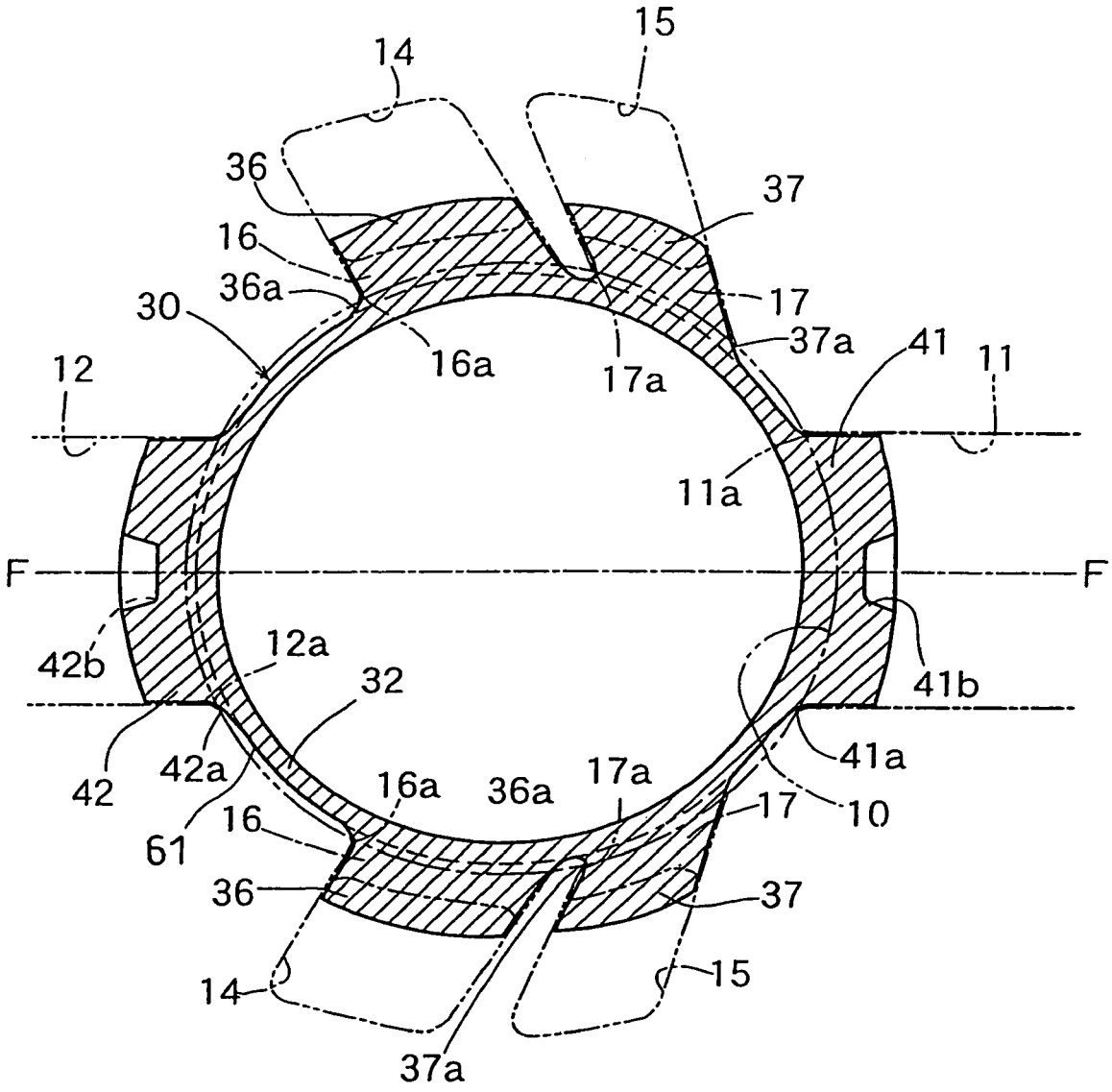
FIG. 2 is a cross-sectional view of the insert core shown in FIG. 1, wherein the scavenging port-forming portions, suction port-forming portion, and exhaust port-forming portion thereof are depicted assuming that they are arranged on the same plane.

As shown in FIG. 1, it is preferable to construct the cylindrical body 32 in such a manner that the cylindrical body 32 is provided, at a top edge portion thereof, with an engaging cut portion 32*a* for preventing the cylindrical body 32 from rotating on the occasion of lathe turning, as required, the inner or outer surface of the insert core 30, and at a lower edge portion thereof, with a positioning cut portion 32*b* for facilitating the alignment of the cylindrical body 32 with a casting mold to be explained hereinafter.

Figure 11:
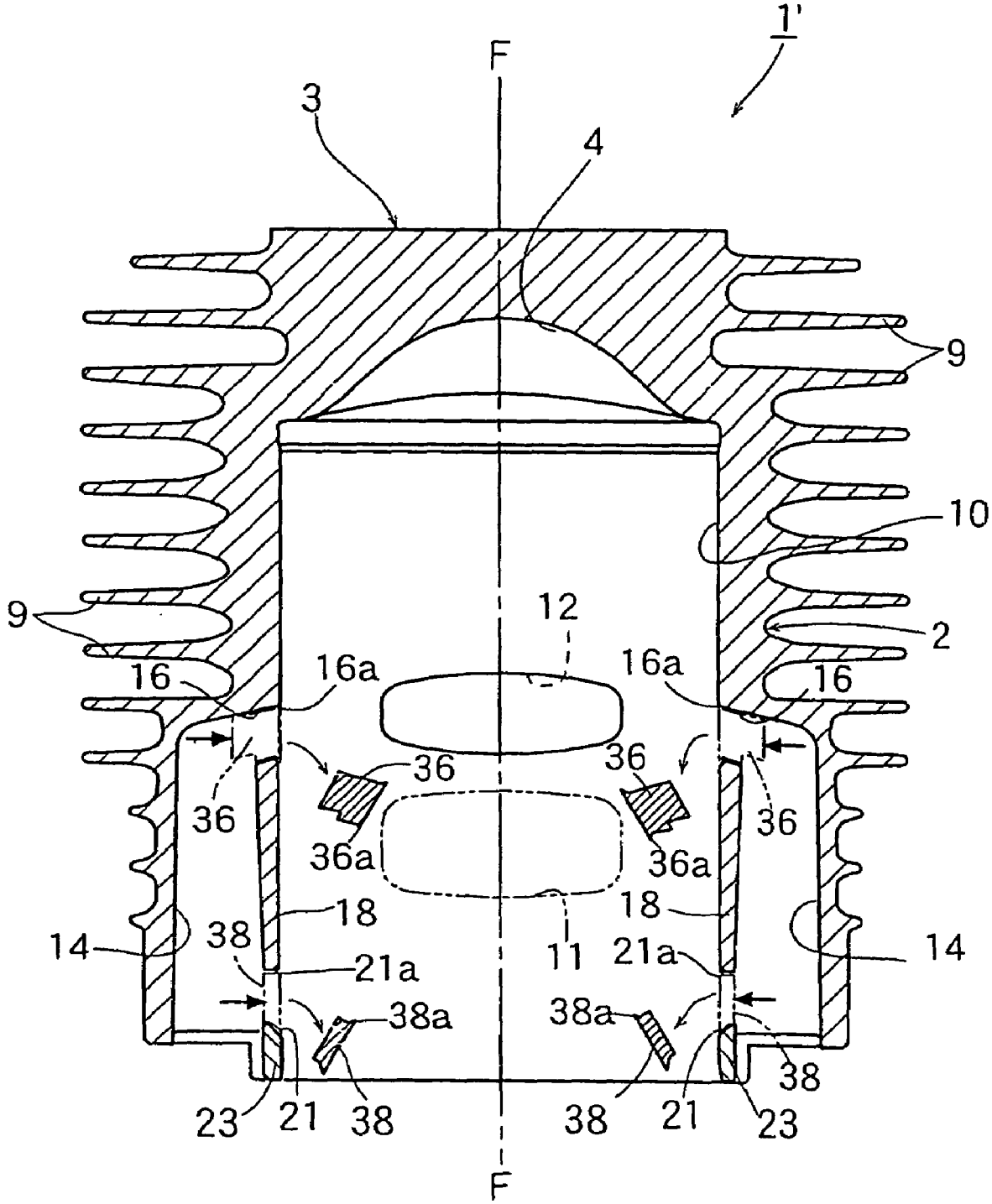
FIG. 11 is a longitudinal sectional view for illustrating a process of removing, by making use of a press or other suitable apparatus, the scavenging port-forming portion of the insert core that could not have been removed in the rough boring process shown in FIGS. 9 and 10, wherein the scavenging duct is longitudinally sectioned.
Figure 12:
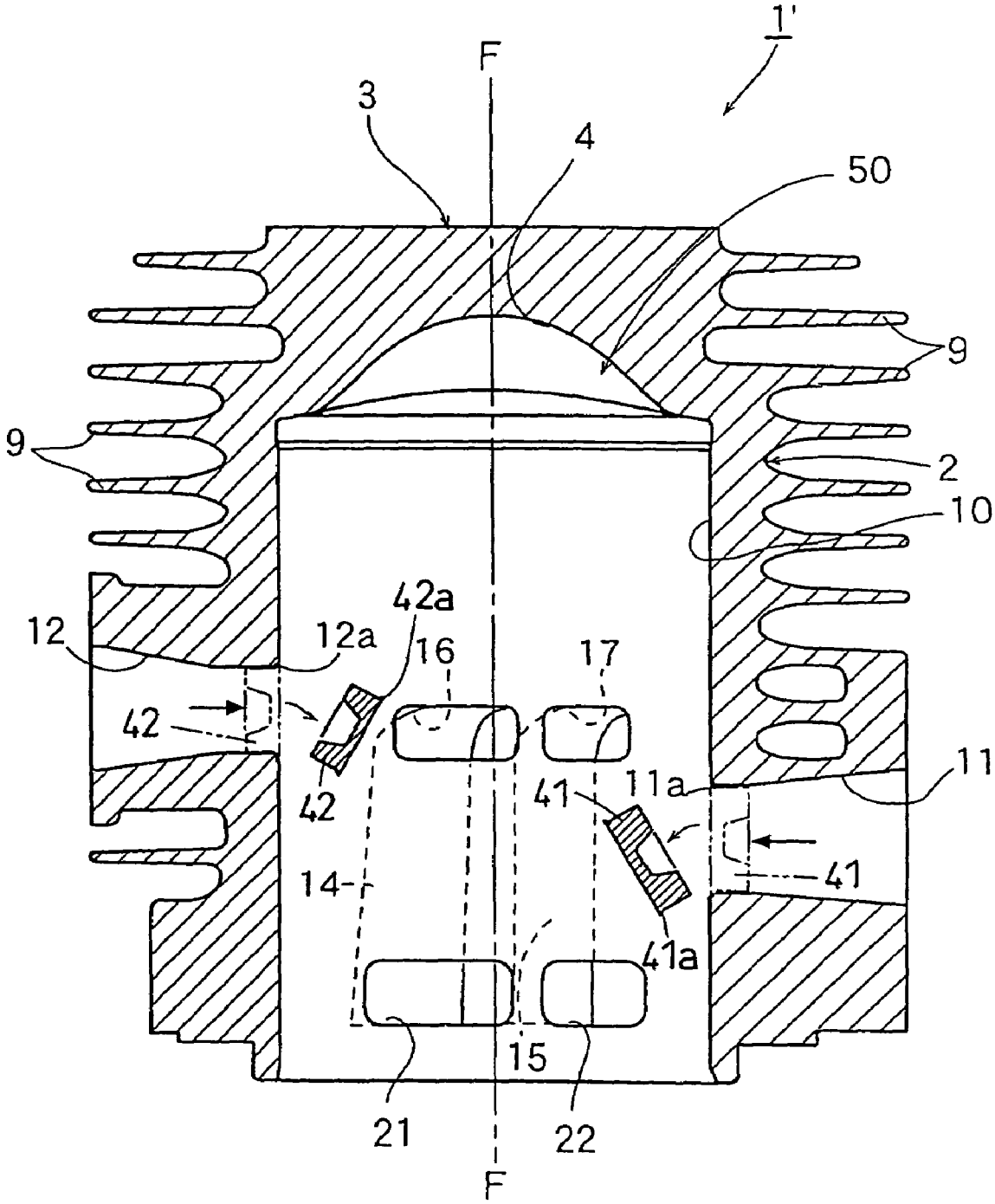
FIG. 12 is a longitudinal sectional view for illustrating a process of removing, by making use of a press or other suitable apparatus, the suction port-forming portion and exhaust port-forming portion of the insert core that could not have been removed in the rough boring process shown in FIGS. 9 and 10, wherein the suction port and the exhaust port are respectively longitudinally sectioned.

All of the scavenging port-forming portions 36 and 37, all of the scavenging inlet opening-forming portions 38 and 39, the suction port-forming portion 41, the exhaust port-forming portion 42, the core 46 for suction port, and the core 47 for exhaust port are constructed such that the proximal end portions thereof (including the chamfered portion-forming portions 36*a*, 37*a*, 38*a*, 39*a*, 41*a* and 42*a*) are all diverged or gradually enlarged in the direction of the cylindrical body 32 so as to conform with the cylinder bore-side end portions of the scavenging outlet ports 16 and 17, of the scavenging inlet openings 21 and 22, of the suction port 11, and of the exhaust port 12 (in order to permit the aforementioned proximal end portions to be removed by pushing them into the inside of the cylinder bore 10 as shown in FIGS. 11 and 12 to be explained hereinafter).

Further, the outer surface of the insert core 30 may be entirely covered, as required, with a mold-releasing layer 61 which may be formed by coating or plating a parting agent such as chromium or nickel.

The application of this mold-releasing layer 61 may be generally limited to the outer surfaces of the scavenging port-forming portions 36 and 37, the scavenging inlet opening-forming portions 38 and 39, the suction port-forming portion 41, and the exhaust port-forming portion 42. However, in view of preventing the surface portion of the cylinder bore 10 from being torn off on the occasion of cutting out the cylindrical portion 32 of the insert core 30 as discussed below, it is more advisable to form the mold-releasing layer 61 all over the outer surface of the insert core 30 as described above.

Figure 3:
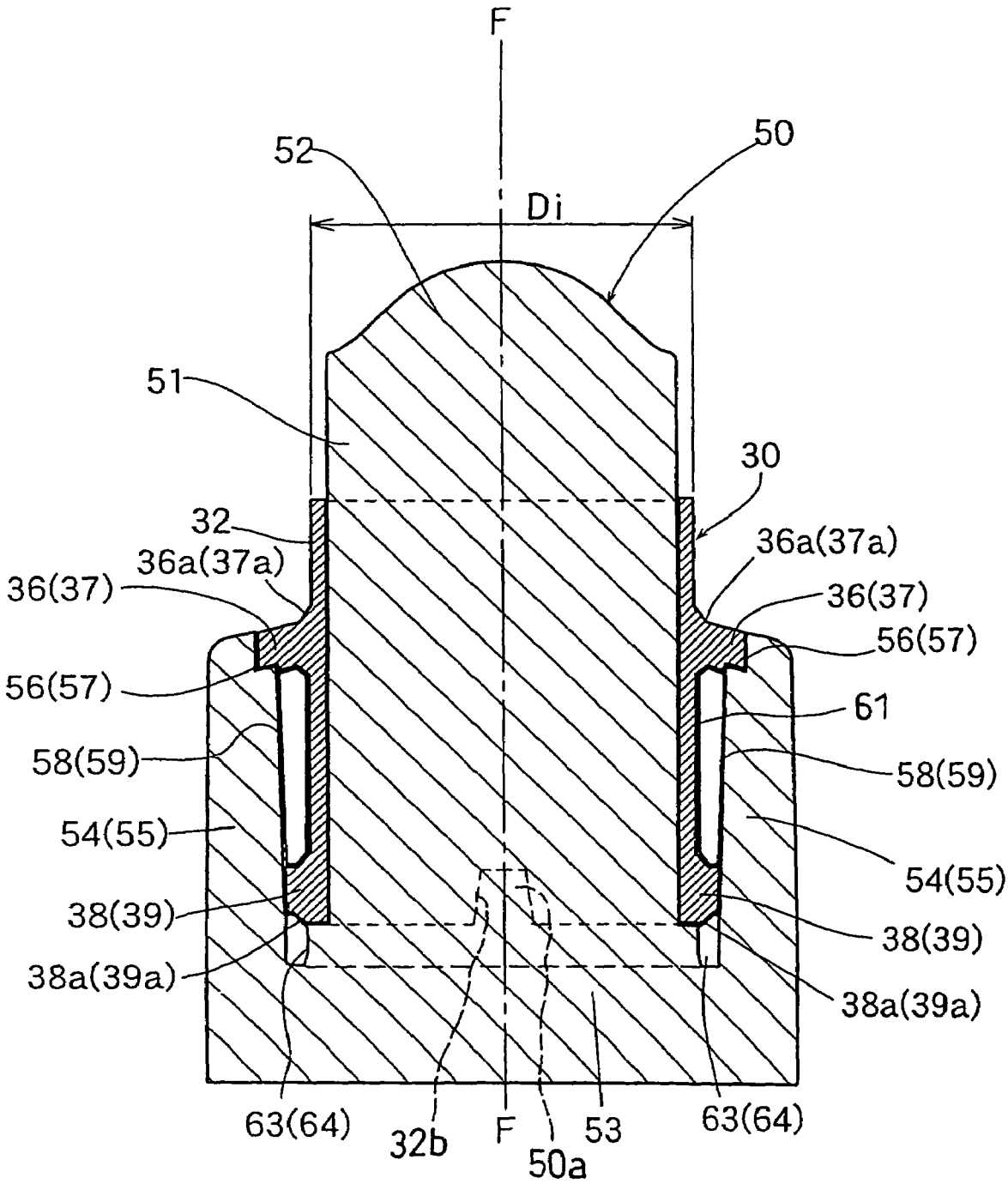
FIG. 3 is a longitudinal sectional view of the scavenging port-forming portion of the insert core of FIG. 1, as the insert core is set in position in a bore-core die.

In the manufacture of the cylinder 1 by making use of the aforementioned insert core 30, the positioning cut portion 32*b* of insert core 30 is engaged with the projected portion 50*a* of the bore-core die 50, thereby setting the insert core 30 in position as shown in FIGS. 3 and 4, and at the same time, the core 46 for suction port, and the core 47 for exhaust port are respectively mounted on the suction port-forming portion 41, and the exhaust port-forming portion 42 (the bosses 46*a* and 47*a* are fitted in the fitting holes 41*b* and 42*b*, respectively), thereby performing the relative positioning of these cores, and at the same time, preventing the fall-off of these cores.

The bore-core die 50 is an ordinary core die to be employed in a high pressure die casting method, and comprises a columnar bore insertion portion 51 on which the cylindrical portion 32 of the insert core 30 is fitted, a combustion chamber-forming portion 52 which is formed contiguous with the upper portion of the bore insertion portion 51 and configured to correspond with the combustion chamber 4 of the cylinder 1, a columnar lower bore portion-forming portion 53 which is formed contiguous with the lower end of the bore insertion portion 51, a pair of scavenging passage-forming portions 54 (55) which are formed contiguous with the right and left sides of the lower bore portion-forming portion 53, the scavenging passage-forming portions 54 (55) corresponding with the scavenging ducts 14 and 15, respectively.

The bore insertion portion 51 has an outer diameter which is almost the same in size as the inner diameter of the insert core 30. Further, the lower bore portion-forming portion 53 has an outer diameter which is larger than the outer diameter of the bore insertion portion 51, thereby enabling it to receive and engage with the cylindrical portion 32 of the insert core 30. Further, a pair of scavenging passage-forming portions 54 and another pair of scavenging passage-forming portions 55 shown in FIG. 3 are respectively provided with cut-out portions 56 (57) into which the scavenging port-forming portions 36 and 37 of the insert core 30 can be inserted, with an intermediate wall-forming spaces 58 (59) which correspond with the configuration of the intermediate wall portions 18 and 19, and also with a lower wall-forming spaces 63 (64) which correspond with the configuration of the lower wall portions 23 (24).

Figure 5:
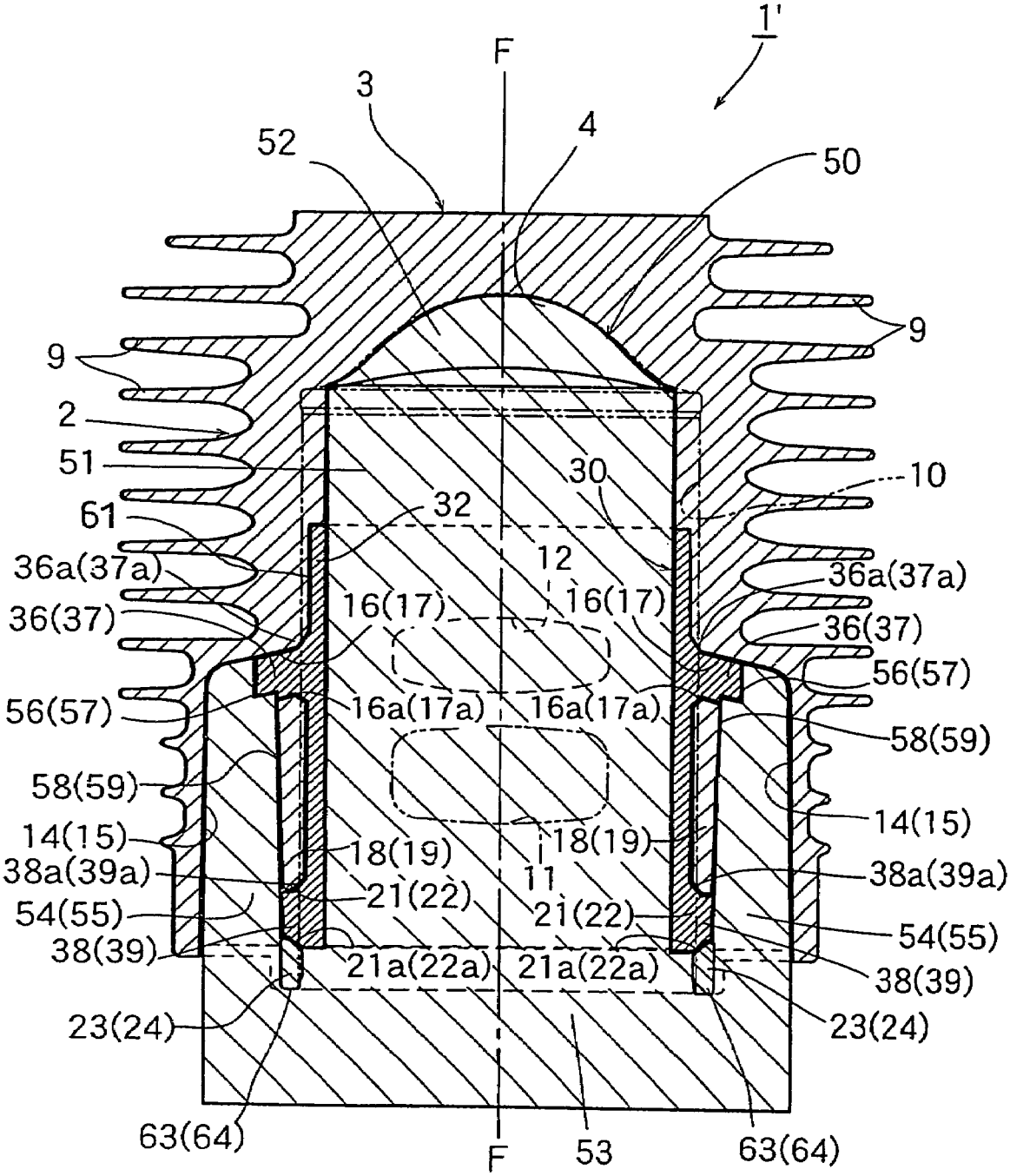
FIG. 5 is a longitudinal sectional view for illustrating the die casting process where the insert core of FIG. 1 and the bore-core die are employed, and wherein the scavenging passageway is longitudinally sectioned.
Figure 6:
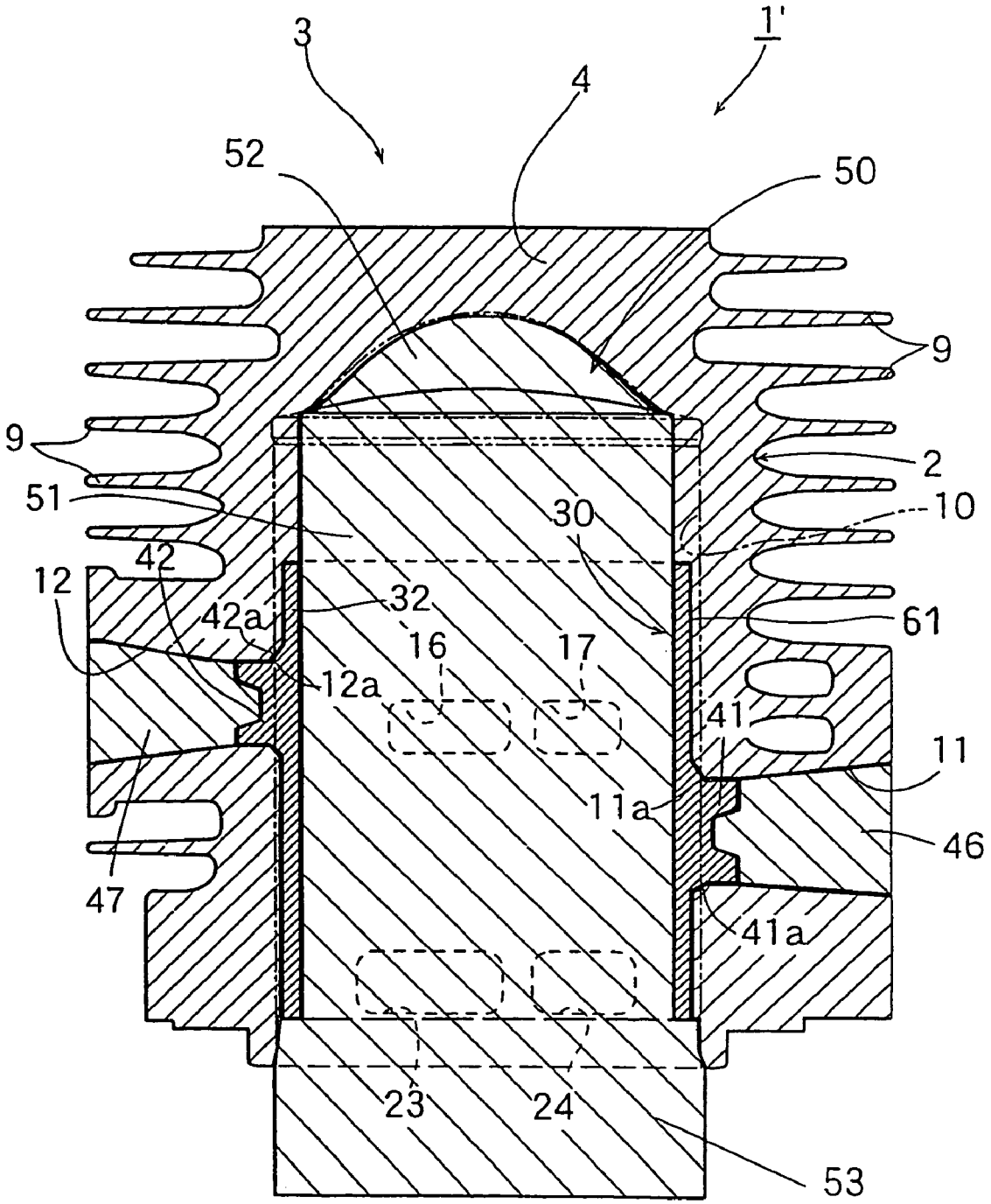
FIG. 6 is a longitudinal sectional view for illustrating the die casting process where the insert core of FIG. 1 and the bore-core die are employed, and wherein the suction port and the exhaust port are respectively longitudinally sectioned.
Figure 7:
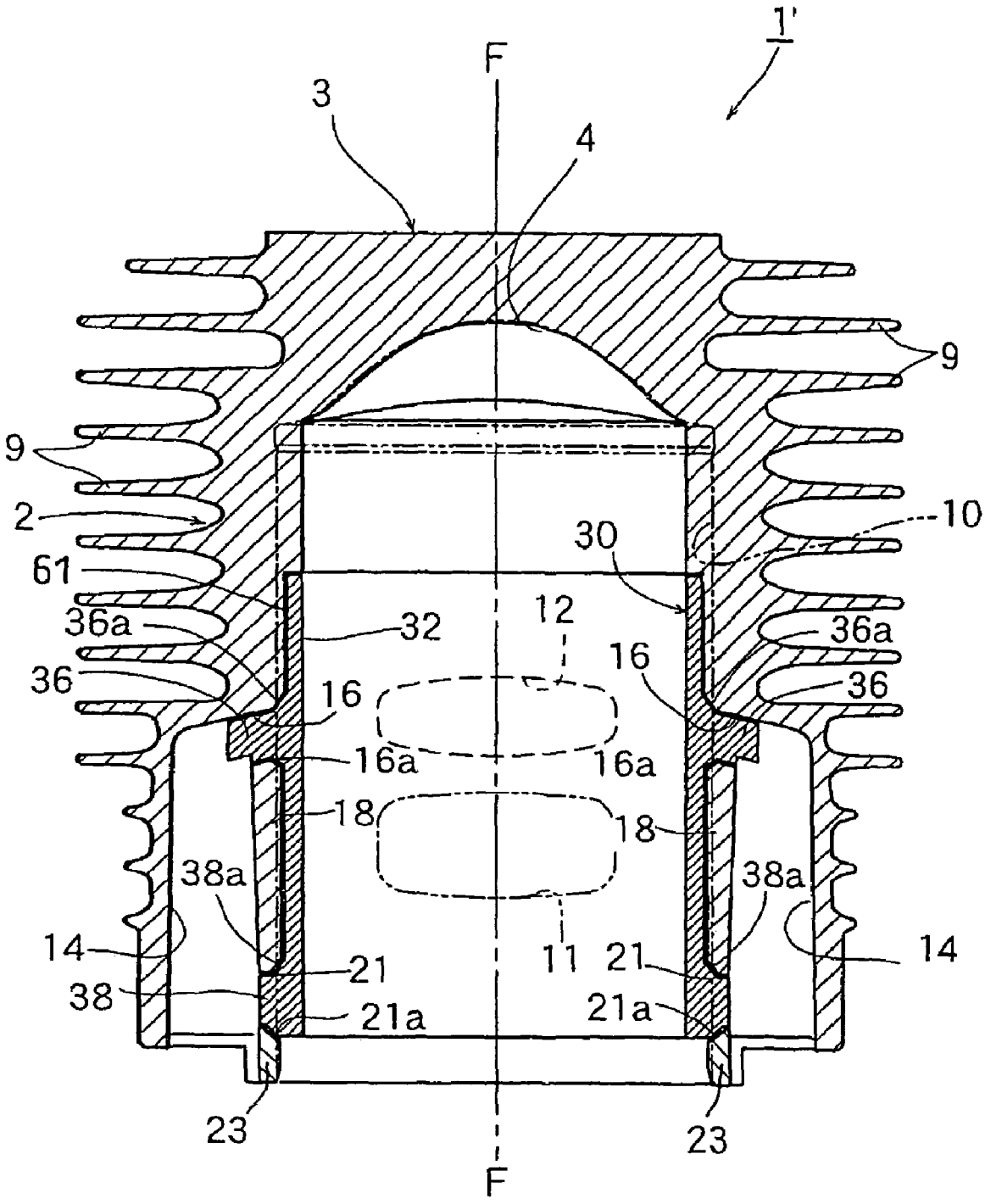
FIG. 7 is a longitudinal sectional view illustrating a raw cylinder which was obtained in the die casting process shown in FIGS. 5 and 6, wherein the scavenging passageway is longitudinally sectioned.
Figure 8:
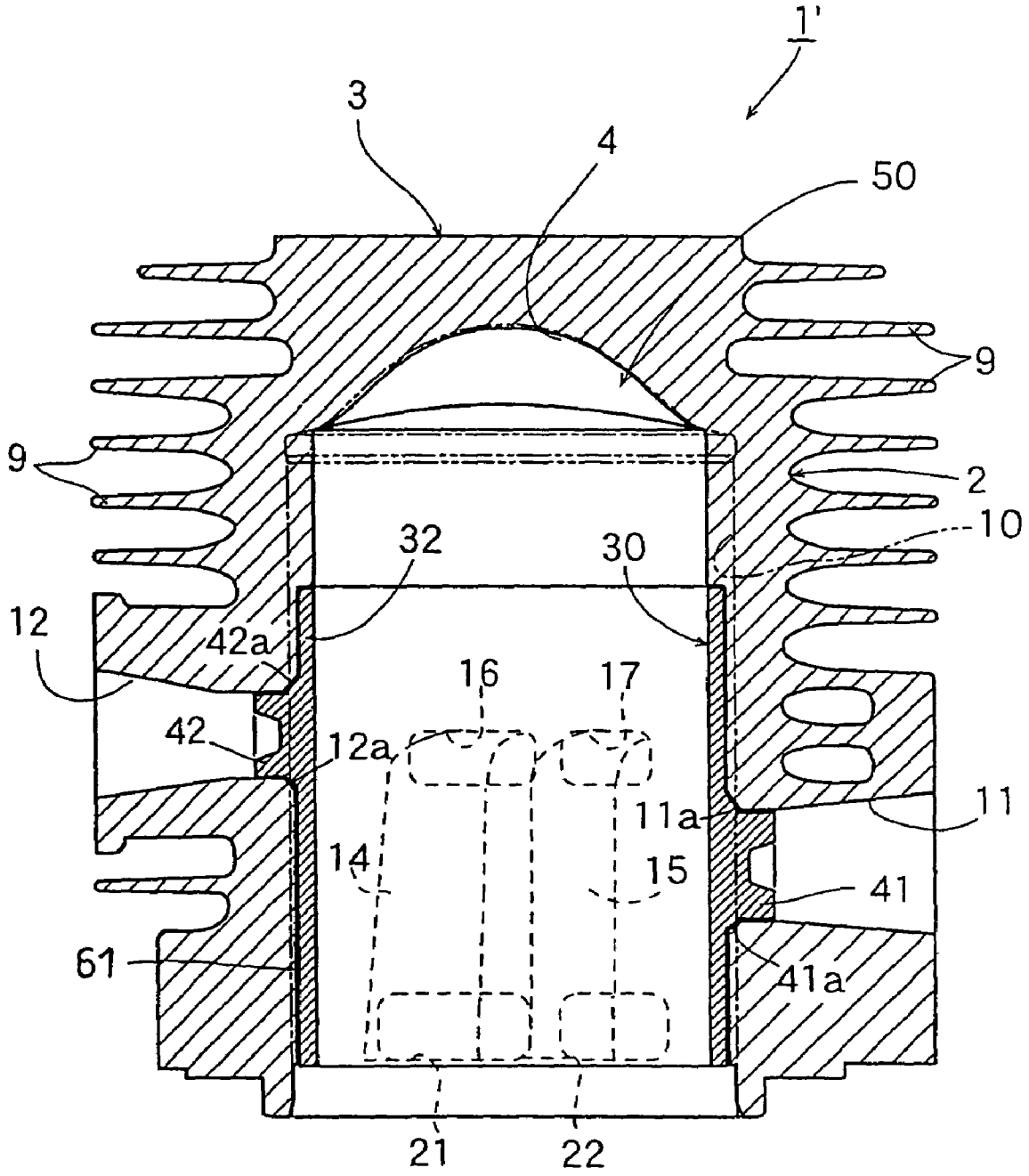
FIG. 8 is a longitudinal sectional view illustrating a raw cylinder body which was obtained in the die casting process shown in FIGS. 5 and 6, wherein the suction port and the exhaust port are respectively longitudinally sectioned.

As described above, the insert core 30 is set in the bore-core die 50, and the core 46 for suction port, and the core 47 for exhaust port are positioned as described above. Thereafter, as shown in FIGS. 5 and 6, the die casting by the high pressure die casting (wherein melt of aluminum alloy for forming the cylinder is injected into the die) is performed. Subsequently, the bore-core die 50, the core 46 for suction port, and the core 47 for exhaust port are respectively pulled out to obtain a raw cylinder body 1' with the insert core 30 being left remained therein as shown in FIGS. 7 and 8.

Under this condition, although the insert core 30 is closely adhered to the bore 10 of the raw cylinder body 1' thus obtained, the possibility of generating problem such as a fusion-bonding between these members can be obviated if the mold-releasing layer 61 is formed in advance as mentioned above on the outer surface of the insert core 30.

Figure 9:
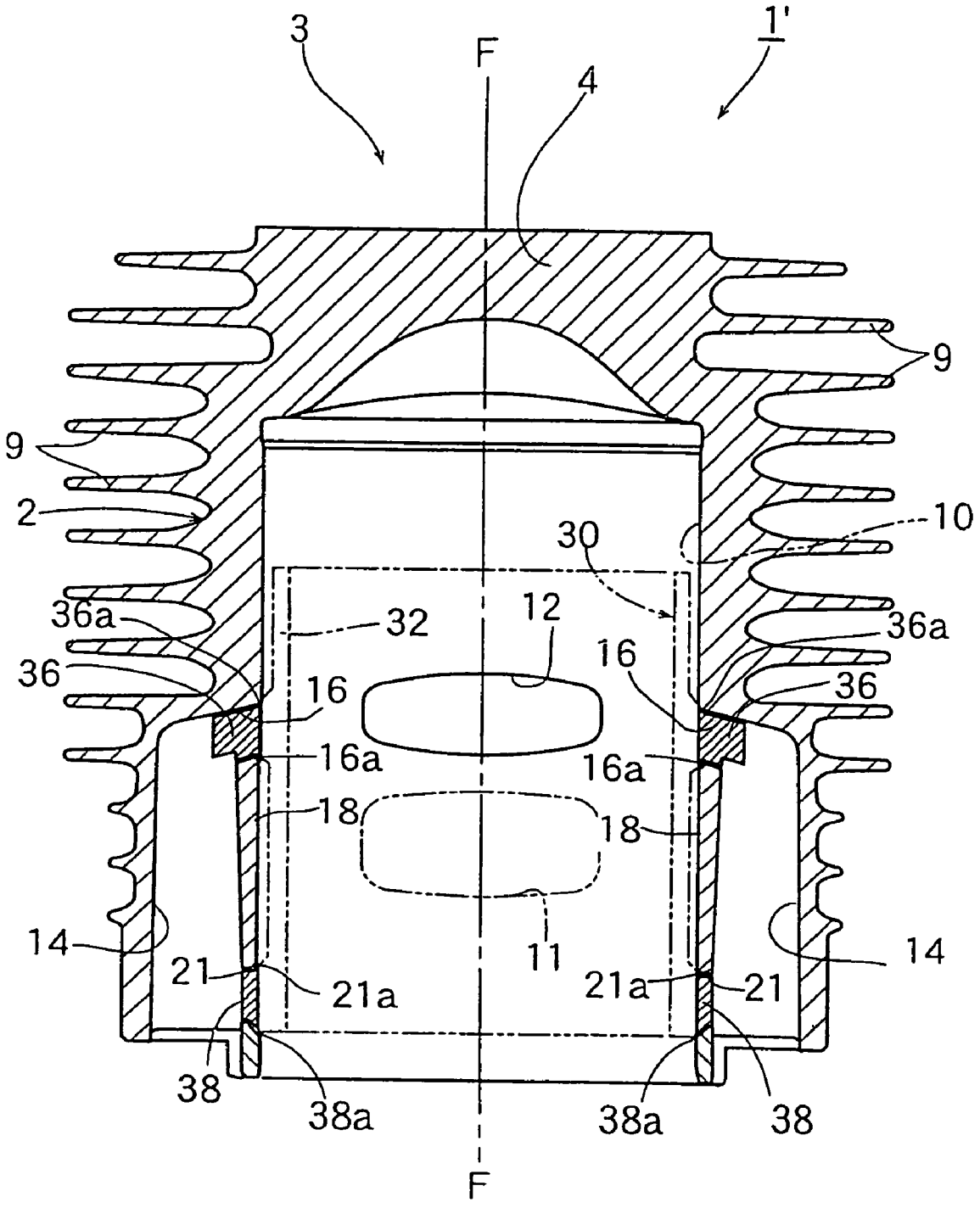
FIG. 9 is a longitudinal sectional view for illustrating a rough boring process for cutting and removing the cylindrical portion of the insert core, which can be performed by the rough boring of the cylinder bore of raw cylinder body produced by a die casting process shown in FIGS. 7 and 8, wherein the scavenging duct is longitudinally sectioned.
Figure 10:
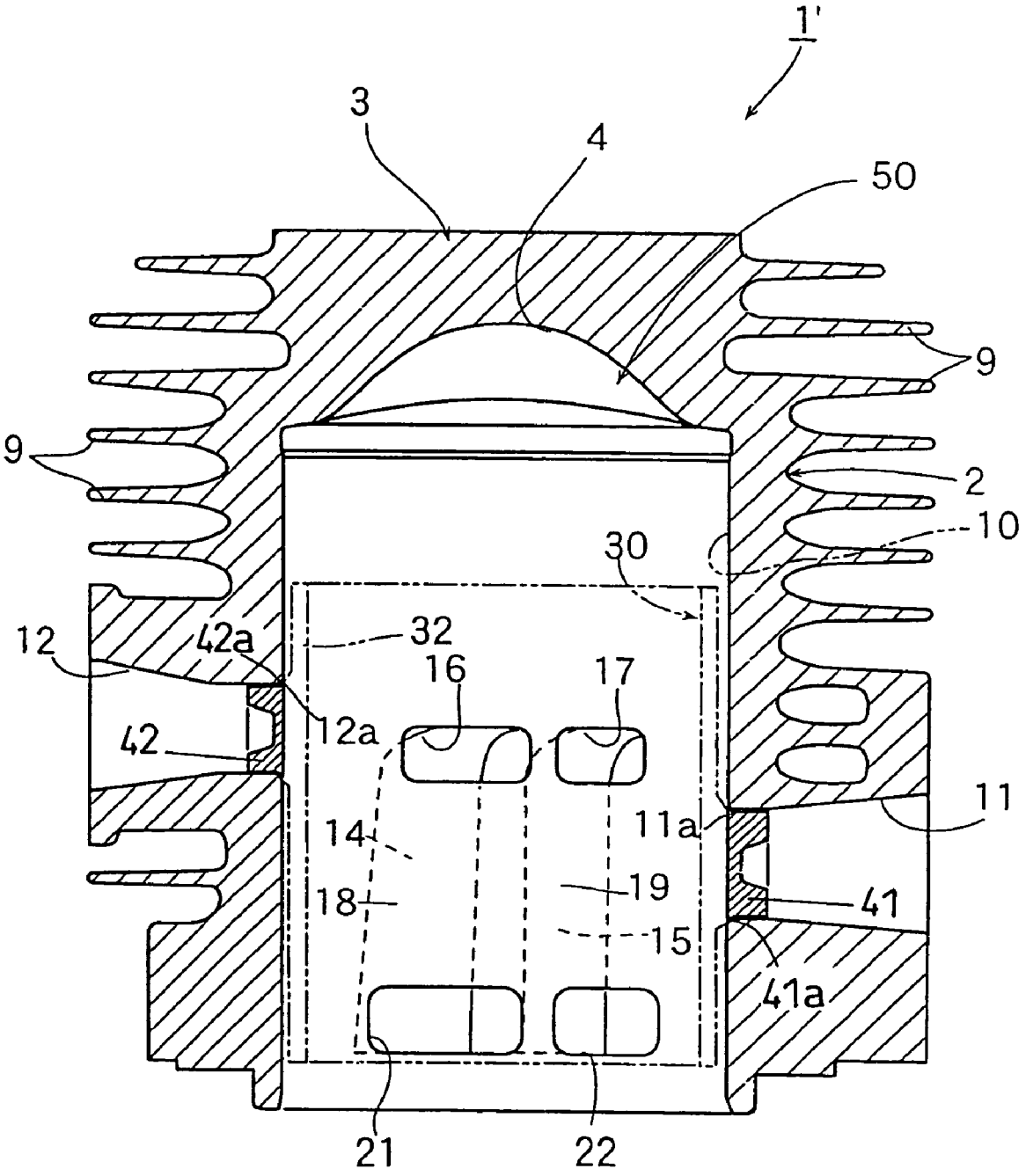
FIG. 10 is a longitudinal sectional view for illustrating a rough boring process for cutting and removing the cylindrical portion of the insert core, which can be performed by the rough boring of the cylinder bore of a raw cylinder body produced by a die casting process shown in FIGS. 7 and 8, wherein the suction port and the exhaust port are respectively longitudinally sectioned.

Thereafter, as shown in FIGS. 9 and 10, the rough boring of the cylinder bore 10 of the raw cylinder body 1' is performed to thereby cut off and remove the cylindrical portion 32 of the insert core 30. On this occasion, an upper end portion of the cylinder bore 10 (a raw material portion existing at an upper portion of the insert core 30) is also cut out and shaped simultaneous with the removal of the insert core 30.

Then, as shown in FIGS. 11 and 12, the scavenging port-forming portions 36 and 37 and the scavenging inlet opening-forming portions 38 and 39 of the insert core 30, which are left remained in the raw cylinder body 1', are pushed out inward in radial direction (toward the inside of the cylinder bore 10) by making use of a press, for example, or other suitable apparatus, to thereby remove the scavenging port-forming portions 36 and 37 and the scavenging inlet opening-forming portions 38 and 39 from the raw cylinder body 1'. In this case, since the scavenging port-forming portions 36 and 37 and the scavenging inlet opening-forming portions 38 and 39 are formed so as to gradually expand toward the inside of the cylinder bore 10, they can be easily removed by the application of a pushing force thereto from the cylinder bore 10 side by making use of a press or other suitable apparatus.

Likewise, the suction opening-forming portion 41 and the exhaust port-forming portion 42, which are left remained in the raw cylinder body 1', are pushed out inward in radial direction (toward the inside of the cylinder bore 10) by making use of a press to thereby remove them from the raw cylinder body 1'. In this case also, since the suction opening-forming portion 41 and the exhaust port-forming portion 42 are formed so as to gradually expand toward the inside of the cylinder bore 10, they can be easily removed by the application of a pushing force thereto from the cylinder bore 10 side by making use of a press, for example, or other suitable apparatus.

Thereafter, the scavenging port-forming portions 36 and 37, the scavenging inlet opening-forming portions 38 and 39, the suction port-forming portion 41, and the exhaust port-forming portion 42 are removed to obtain a finished cylinder 1, as shown in FIGS. 13 and 14, having chamfered portions (chamfered along the entire circumference thereof) 16*a*, 17*a*, 21*a*, 22*a*, 11*a* and 12*a* formed at the rim portion, on the cylinder bore side, of the scavenging outlet ports 16 and 17, of the scavenging inlet openings 21 and 22, of the suction port 11, and of the exhaust port 12, respectively.

According to the method of manufacturing a cylinder 1 for a two-stroke internal combustion engine by making use of the insert core 30 of this embodiment which is constructed as described above, it is possible, due to the employment of the insert core 30, to utilize a high-pressure die casting method which enables to obtain a cast article of high dimensional accuracy. Additionally, since the cylindrical portion 32 of the insert core 30 can be removed by way of a rough boring of the cylinder bore 10 after the die casting, and since the scavenging port-forming portions 36 and 37, the scavenging inlet opening-forming portions 38 and 39, the suction port-forming portion 41, and the exhaust port-forming portion 42 of the insert core 30 that cannot be removed by the rough boring can be easily removed by making use of a press in a subsequent step, it is possible to make the resultant article (cylinder) completely free from any residuals of the insert core.

As a result, a cylinder can be manufactured in higher precision and at lower cost as compared with the conventional method of cutting out the scavenging port portion by mechanical means after die casting or with the conventional manufacturing method by die casting where an insert core to be inserted into the scavenging port portion is employed. At the same time, the aforementioned problems of the deterioration of heat conductivity, and the deformation or peeling of these port portions due to the remnant of the insert core in the cast article (cylinder) can be prevented to occur.

Furthermore, since all of these scavenging port-forming portions 36 and 37, the scavenging inlet opening-forming portions 38 and 39, suction port-forming portion 41, and exhaust port-forming portion 42 are formed integral with the insert core 30 (the cylindrical portion 32 thereof), it is possible to univocally determine the relative positions of the scavenging ports 16 and 17, the scavenging inlet openings 21 and 22, the suction port 11, and the exhaust port 12, thereby obviating the possibility of relative mismatching among the scavenging ports 16 and 17, the scavenging inlet openings 21 and 22, the suction port 11, and the exhaust port 12 that may be caused to occur in the conventional manufacturing method where these scavenging port-forming portions, the scavenging inlet openings, suction port-forming, portion and exhaust port-forming portion are disposed separate from the insert core. Therefore, it is now possible to obtain a cylinder excellent in dimensional precision.

Additionally, since the configurations of the scavenging port-forming portion 36 and 37, the scavenging inlet opening-forming portions 38 and 39, the suction port-forming portion 41, and the exhaust port-forming portion 42 can be optionally selected as long as they can be physically detached or removed after the die casting, the configuration, contraction ratio and inclination angle of these scavenging ports 16 and 17, the scavenging inlet openings 21 and 22, suction port 11, and exhaust port 12 can be optionally selected, thereby increasing the degree of freedom in designing these ports as compared with the case where these ports are formed by electric discharge machining and at the same time, making it possible to minimize the manufacturing cost of the cylinder.

Additionally, according to the method of manufacturing a cylinder for an internal combustion engine as illustrated in this embodiment, the scavenging port-forming portion 36 and 37, the scavenging inlet opening-forming portions 38 and 39, the suction port-forming portion 41, and exhaust port-forming portion 42 of the insert core 30 are respectively provided with chamfered portion-forming portions 36*a*, 37*a*, 38*a*, 39*a*, 41*a* and 42*a* for forming chamfered portions (chamfered along the entire circumference thereof) 16*a*, 17*a*, 21*a*, 22*a*, 11*a* and 12*a*, respectively, at each of the rim portions, on the cylinder bore side, of the scavenging ports 16 and 17, the scavenging inlet openings 21 and 22, the suction port 11, and the exhaust port 12. Therefore, it is now possible to provide the scavenging ports 16 and 17, the scavenging inlet openings 21 and 22, the suction port 11, and the exhaust port 12 with chamfered portions (chamfered along the entire circumference thereof) 16*a*, 17*a*, 21*a*, 22*a*, 11*a* and 12*a*, respectively, at each of their cylinder bore-side rim portions, by the procedures wherein after a cast-molded raw cylinder body 1' having the insert core 30 placed therein is obtained, the resultant raw cylinder body 1' is subjected to boring to remove a cylindrical portion 32 of the insert core 30, and then, the scavenging port-forming portions 36 and 37, the scavenging inlet opening-forming portions 38 and 39, the suction port-forming portion 41 and the exhaust port-forming portion 42 of the insert core 30, which are left remained in the raw cylinder body 1', are removed by being pushed radially inward by making use of a press, for example, or other suitable apparatus. Therefore, it is no longer required to perform the chamfering working, on the cylinder bore side, of each of these ports and openings after the manufacture of the cylinder.

In this case, since it is possible to design the chamfered portion-forming portions 36*a*, 37*a*, 38*a*, 39*a*, 41*a* and 42*a* in any optional configuration at each of the scavenging port-forming portions 36 and 37, the scavenging inlet opening-forming portions 38 and 39, the suction port-forming portion 41 and the exhaust port-forming portion 42 of the insert core 30, the chamfered portions 16*a*, 17*a*, 21*a*, 22*a*, 11*a* and 12*a* to be formed on the cylinder bore side of the scavenging ports 16 and 17, the scavenging inlet openings 21 and 22, the suction port 11 and the exhaust port 12 can be freely varied in size and configuration along the entire circumference of the openings of these ports, thereby making it possible to greatly enhance the freedom in size and configuration of these chamfered portions.

Moreover, since the size and configuration of the chamfered portion-forming portions 16*a*, 17*a*, 21*a*, 22*a*, 11*a* and 12*a* can be fixed in advance, it is now possible to form the chamfered portions with higher precision and with minimal irregularity in size and configuration of the chamfered portion as compared with the chamfered portions that can be formed in the conventional manner such as manual working, mechanical machining, electro-chemical machining, electric discharge machining, or other suitable method. Furthermore, it is also possible, according to the manufacturing method of the present invention, to reduce the cost for forming the chamfered portion and to obtain the cylinder which is excellent in uniformity on the occasion of mass-producing the cylinder 1. Additionally, a curved chamfered portion (radiused configuration and the like) that cannot be easily achieved by the conventional method such as manual working, mechanical machining, electro-chemical machining, electric discharge machining, or other traditional methods can be easily obtained by the manufacturing method as proposed by the present invention.

Further, since it is possible to univocally determine the size and configuration of each of the chamfered portions 16*a*, 17*a*, 21*a*, 22*a*, 11*a* and 12*a*, the generation of relative miss-matching among the scavenging ports 16 and 17, the scavenging inlet openings 21 and 22, the suction port 11 and the exhaust port 12 (the location of openings of these ports) can be suppressed. As a result, it is now possible to properly maintain the timing of opening and closing these ports by the piston all the time, thereby making it possible to secure the prescribed performance desired of the engine.

While in the foregoing one embodiment of the present invention has been explained in details for the purpose of illustration, it will be understood that the construction of the device can be varied without departing from the spirit and scope of the invention as claimed in the following claims.

What is claimed is:

1. A combination for an internal combustion engine, comprising:

a cylinder comprising:

a cylindrical body having a slightly smaller outer diameter than the diameter of bore of the cylinder to be obtained;

a scavenging port-forming portion projecting radially outward from the cylindrical body and having substantially the same cross-sectional configuration as that of the scavenging port;

a suction port-forming portion projecting radially outward from the cylindrical body and having substantially the same cross-sectional configuration as that of at least the cylinder bore-side end portion of an suction port;

an exhaust port-forming portion projecting radially outward from the cylindrical body and having substantially the same cross-sectional configuration as that of at least the cylinder bore-side end portion of an exhaust port; and an insert core capable of cooperating with the cylinder comprising:

chamfered portion-forming portions for forming a chamfered portion at each of the rim portions on the cylinder bore side of said scavenging port, said suction port, and said exhaust port.

2. The invention of claim 1, wherein said insert core is formed as an integral body by a die casting method using an aluminum alloy as a raw material.

3. The invention of claim 2, wherein said cylinder is manufactured by a process wherein the insert core is externally attached to a bore-core die, the resultant casting die is then employed to cast-mold a raw cylinder body with the insert core being left remained therein, the resultant raw cylinder body is then subjected to boring for forming a cylinder bore to remove a cylindrical portion of the insert core, and the scavenging port-forming portion, suction port-forming portion, and exhaust port-forming portion of the insert core, which are left remained in the raw cylinder body, are removed by being pushed radially inward thus obtaining a cylinder having a chamfered portion formed at each of the rim portions, on the cylinder bore side, of said scavenging port, said suction port, and said exhaust port.

4. The invention of claim 1, wherein said cylinder is manufactured by a process wherein the insert core is externally attached to a bore-core die, the resultant casting die is then employed to cast-mold a raw cylinder body with the insert core being left remained therein, the resultant raw cylinder body is then subjected to boring for forming a cylinder bore to remove a cylindrical portion of the insert core, and the scavenging port-forming portion, suction port-forming portion, and exhaust port-forming portion of the insert core, which are left remained in the raw cylinder body, are removed by being pushed radially inward thus obtaining a cylinder having a chamfered portion formed at each of the rim portions, on the cylinder bore side, of said scavenging port, said suction port, and said exhaust port.

5. The invention of claim 4, wherein a parting agent is coated or plated on an outer surface of at least the scavenging port-forming portion, the suction port-forming portion, and the exhaust port-forming portion of the insert core, thereby forming a mold-releasing layer prior to the step of die casting.

6. The invention of claim 1, wherein a parting agent is coated or plated on an outer surface of at least the scavenging port-forming portion, the suction port-forming portion, and the exhaust port-forming portion of the insert core, thereby forming a mold-releasing layer prior to the step of die casting.

7. The invention of claim 2, wherein a parting agent is coated or plated on an outer surface of at least the scavenging port-forming portion, the suction port-forming portion, and the exhaust port-forming portion of the insert core, thereby forming a mold-releasing layer prior to the step of die casting.

8. The invention of claim 3, wherein a parting agent is coated or plated on an outer surface of at least the scavenging port-forming portion, the suction port-forming portion, and the exhaust port-forming portion of the insert core, thereby forming a mold-releasing layer prior to the step of die casting.

9. A combination for an internal combustion engine, comprising:

a cylinder comprising:

a cylindrical body having a slightly smaller outer diameter than the diameter of bore of the cylinder to be obtained;

a scavenging port-forming portion projecting radially outward from the cylindrical body and having substantially the same cross-sectional configuration as that of the scavenging port;

a suction port-forming portion projecting radially outward from the cylindrical body and having substantially the same cross-sectional configuration as that of at least the cylinder bore-side end portion of an suction port;

an exhaust port-forming portion projecting radially outward from the cylindrical body and having substantially the same cross-sectional configuration as that of at least the cylinder bore-side end portion of an exhaust port; and an insert core capable of cooperating with the cylinder comprising:

chamfered portion-forming portions for forming a chamfered portion at each of the rim portions on the cylinder bore side of said scavenging port, said suction port, and said exhaust port; and wherein said cylinder is manufactured by a process wherein the insert core is externally attached to a bore-core die, the resultant casting die is then employed to cast-mold a raw cylinder body with the insert core being left remained therein, the resultant raw cylinder body is then subjected to boring for forming a cylinder bore to remove a cylindrical portion of the insert core, and the scavenging port-forming portion, suction port-forming portion, and exhaust port-forming portion of the insert core, which are left remained in the raw cylinder body, are removed by being pushed radially inward thus obtaining a cylinder having a chamfered portion formed at each of the rim portions, on the cylinder bore side, of said scavenging port, said suction port, and said exhaust port.

10. The invention of claim 9, wherein said insert core is formed as an integral body by a die casting method using an aluminum alloy as a raw material.

11. The invention of claim 9, wherein said cylinder is manufactured by a process wherein the insert core is externally attached to a bore-core die, the resultant casting die is then employed to cast-mold a raw cylinder body with the insert core being left remained therein, the resultant raw cylinder body is then subjected to boring for forming a cylinder bore to remove a cylindrical portion of the insert core, and the scavenging port-forming portion, suction port-forming portion, and exhaust port-forming portion of the insert core, which are left remained in the raw cylinder body, are removed by being pushed radially inward thus obtaining a cylinder having a chamfered portion formed at each of the rim portions, on the cylinder bore side, of said scavenging port, said suction port, and said exhaust port.

12. The invention of claim 11, wherein a parting agent is coated or plated on an outer surface of at least the scavenging port-forming portion, the suction port-forming portion, and the exhaust port-forming portion of the insert core, thereby forming a mold-releasing layer prior to the step of die casting.

13. The invention of claim 9, wherein a parting agent is coated or plated on an outer surface of at least the scavenging port-forming portion, the suction port-forming portion, and the exhaust port-forming portion of the insert core, thereby forming a mold-releasing layer prior to the step of die casting.

14. The invention of claim 10, wherein a parting agent is coated or plated on an outer surface of at least the scavenging port-forming portion, the suction port-forming portion, and the exhaust port-forming portion of the insert core, thereby forming a mold-releasing layer prior to the step of die casting.

* * * * *